US006293180B1

(12) United States Patent
Morisako et al.

(10) Patent No.: US 6,293,180 B1
(45) Date of Patent: Sep. 25, 2001

(54) SPEED CONTROLLER WITH PILOT CHECK VALVE

(75) Inventors: Noritaka Morisako, Toride; Shizuo Mori, Ryugasaki, both of (JP)

(73) Assignee: SMC Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/621,608

(22) Filed: Jul. 21, 2000

Related U.S. Application Data

(62) Division of application No. 08/974,637, filed on Nov. 19, 1997, now Pat. No. 6,131,610.

(30) Foreign Application Priority Data

Nov. 22, 1996 (JP) ..... 8-312363

(51) Int. Cl.[7] ..... F15B 13/04
(52) U.S. Cl. ..... 91/420; 91/443; 91/447
(58) Field of Search ..... 91/420, 443, 447

(56) References Cited

U.S. PATENT DOCUMENTS

| | | |
|---|---|---|
| 2,483,312 | 9/1949 | Clay . |
| 2,508,399 | 5/1950 | Kendrick . |
| 2,509,589 | 5/1950 | Deardorff et al. . |
| 2,563,295 | 8/1951 | Westbury . |
| 2,586,785 | 2/1952 | Carr . |
| 2,603,235 | 7/1952 | Kirkham . |
| 2,618,121 | 11/1952 | Tucker . |
| 2,632,472 | 3/1953 | Livers . |
| 2,648,346 | 8/1953 | Deardorff et al. . |
| 2,756,724 | 7/1956 | Stewart et al. . |
| 2,959,188 | 11/1960 | Kepner . |
| 3,030,929 | 4/1962 | Hipp . |
| 3,198,088 | 8/1965 | Johnson et al. . |
| 3,229,721 | 1/1966 | Bingel . |
| 3,274,902 | 9/1966 | Kleckner . |
| 3,335,750 | 8/1967 | Kepner . |
| 3,381,587 | 5/1968 | Parquet . |
| 3,576,192 | 4/1971 | Wood et al. . |
| 3,595,264 | 7/1971 | Martin . |
| 3,596,566 | 8/1971 | Krehbiel et al. . |
| 3,728,941 | 4/1973 | Cryder . |
| 3,792,715 | 2/1974 | Parrett et al. . |
| 3,795,178 | 3/1974 | Roche . |
| 3,807,175 | 4/1974 | Kubik . |
| 3,817,154 | 6/1974 | Martin . |
| 3,818,936 | 6/1974 | Jackoboice et al. . |
| 3,857,404 | 12/1974 | Johnson . |
| 3,908,515 | 9/1975 | Johnson . |
| 3,933,167 | 1/1976 | Byers, Jr. . |
| 3,975,987 | 8/1976 | Panis . |

(List continued on next page.)

FOREIGN PATENT DOCUMENTS

| | | |
|---|---|---|
| 1293034 | 4/1969 | (DE) . |
| 0-520-212-A1 | 12/1992 | (EP) . |
| 0-547-367-A1 | 6/1993 | (EP) . |
| 2455231 | 11/1980 | (FR) . |

*Primary Examiner*—Gerald A. Michalsky
(74) *Attorney, Agent, or Firm*—Morgan & Finnegan, L.L.P.

(57) ABSTRACT

A speed controller has a pilot check valve having a first body which has a first fluid inlet/outlet port defined in an end thereof and a pilot port defined in an opposite end thereof. A flow control valve has a second body integral with the first body. A pipe joint has a third body which has a second fluid inlet/outlet port defined in an end thereof and, the third body being integral with the second body. A flow adjustment screw is disposed in the flow control valve and extends into a fluid passage which interconnects the first fluid inlet/outlet port and the second fluid inlet/outlet port, for adjusting a rate of flow of a fluid under pressure in the fluid passage. A valve body is disposed in the pilot check valve for opening a fluid passage which interconnects the first fluid inlet/outlet port and the second fluid inlet/outlet port in response to a pilot fluid pressure supplied from the pilot port.

7 Claims, 7 Drawing Sheets

U.S. PATENT DOCUMENTS

| | | | | |
|---|---|---|---|---|
| 3,980,000 | | 9/1976 | Iijima et al. . | |
| 3,980,336 | | 9/1976 | Bitonti . | |
| 4,012,031 | | 3/1977 | Mitchell et al. . | |
| 4,018,136 | | 4/1977 | Kaetterhenry . | |
| 4,040,438 | | 8/1977 | Wilke . | |
| 4,073,311 | * | 2/1978 | McGeachy | 91/443 X |
| 4,103,699 | | 8/1978 | Vik . | |
| 4,130,049 | | 12/1978 | Finley et al. . | |
| 4,147,179 | * | 4/1979 | Miura | 91/443 X |
| 4,161,136 | | 7/1979 | Krieger . | |
| 4,165,675 | | 8/1979 | Cryder et al. . | |
| 4,171,007 | * | 10/1979 | Bouteille | 137/853 |
| 4,172,582 | | 10/1979 | Bobnar . | |
| 4,192,338 | | 3/1980 | Gerulis . | |
| 4,192,346 | * | 3/1980 | Iizumi | 91/443 X |
| 4,204,459 | | 5/1980 | Johnson . | |
| 4,221,156 | | 9/1980 | Zirps et al. . | |
| 4,269,111 | | 5/1981 | Kamimura . | |
| 4,286,432 | | 9/1981 | Burrows et al. . | |
| 4,287,812 | | 9/1981 | Iizumi . | |
| 4,290,447 | | 9/1981 | Knutson . | |
| 4,336,826 | | 6/1982 | Grawunde . | |
| 4,344,355 | | 8/1982 | Schwerin . | |
| 4,364,304 | | 12/1982 | Andersen et al. . | |
| 4,461,314 | | 7/1984 | Kramer . | |
| 4,466,336 | | 8/1984 | Broome et al. . | |
| 4,531,449 | | 7/1985 | Reith . | |
| 4,538,644 | | 9/1985 | Knutson et al. . | |
| 4,569,273 | | 2/1986 | Anderson et al. . | |
| 4,624,445 | | 11/1986 | Putnam . | |
| 4,633,762 | | 1/1987 | Tardy . | |
| 4,658,934 | | 4/1987 | Cooper et al. . | |
| 4,722,262 | | 2/1988 | Schneider . | |
| 4,741,249 | | 5/1988 | Legris . | |
| 4,742,849 | * | 5/1988 | Prudhomme et al. | 91/443 X |
| 4,789,002 | | 12/1988 | Williams . | |
| 4,838,306 | | 6/1989 | Horn et al. . | |
| 4,976,336 | | 12/1990 | Curran . | |
| 5,081,904 | * | 1/1992 | Horn et al. | 91/443 X |
| 5,097,747 | | 3/1992 | Levenez . | |
| 5,257,193 | | 10/1993 | Kusaka et al. . | |
| 5,273,693 | | 12/1993 | Rothwell et al. . | |

* cited by examiner

10
X1
X
X2
Y1
Y
Y2
II
II

SPEED CONTROLLER WITH PILOT CHECK VALVE

CROSS-REFERENCE TO RELATED APPLICATIONS

This application is a divisional of U.S. application Ser. No. 08/974,637, filed Nov. 19, 1997, now U.S. Pat. No. 6,131,610.

BACKGROUND OF THE INVENTION

1. Field of the Invention

The present invention relates to a speed controller with a pilot check valve for controlling the rate of flow of a fluid under pressure which is led from a fluid pressure device such as a cylinder, for example, and the rate of flow of a fluid under pressure which is supplied to the fluid pressure device.

2. Description of the Related Art

There have heretofore been used fluid pressure control circuits including a speed controller for controlling the rate of flow of a fluid under pressure that is discharged from and introduced into a fluid pressure device such as a cylinder, for example.

FIG. 7 of the accompanying drawings shows a conventional fluid pressure control circuit 1. As shown in FIG. 7, the fluid pressure control circuit 1 comprises a cylinder 2 having first and second fluid inlet/outlet ports 3, 6, a first speed controller 4 and a first pilot check valve 5 which are connected in series to the first fluid inlet/outlet port 3, a second speed controller 7 and a second pilot check valve 8 which are connected in series to the second fluid inlet/outlet port 6, and a solenoid-operated valve 9 connected to the first speed controller 4 and the second speed controller 7.

The fluid pressure control circuit 1 basically operates as follows: When the solenoid-operated valve 9 is shifted to one position, i.e., to the right in FIG. 7, a fluid, typically air, under pressure supplied from a pressure fluid source (not shown) flows through the first speed controller 4 and the first pilot check valve 5 into the first fluid inlet/outlet port 3, from which the fluid under pressure enters one of cylinder chambers of the cylinder 2. As the piston of the cylinder 2 moves toward the other cylinder chamber under the pressure of the supplied fluid, a fluid under pressure in the other cylinder chamber is discharged from the cylinder 2 and flows through the second pilot check valve 8 and the second speed controller 7 into the solenoid-operated valve 9, from which the fluid under pressure is discharged into the atmosphere. The speed of travel of the piston of the cylinder 2 can be controlled by adjusting the rate of flow of the fluid through the second speed controller 7 to a desired value.

The first speed controller 4 and the second speed controller 7 are made of identical components, but are separate from each other, and the first pilot check valve 5 and the second pilot check valve 8 are also made of identical components, but are separate from each other.

Therefore, the fluid pressure control circuit 1 is constructed of two speed controllers 4, 7, two pilot check valves 5, 8, and a single solenoid-operated valve 9. The solenoid-operated valve 9 is connected to the first and second speed controllers 4, 7 by conduits such as tubes. The second speed controllers 4, 7 are connected to the first and second pilot check valves 5, 8 by conduits such as tubes. The first and second pilot check valves 5, 8 are connected to the cylinder 2 by conduits such as tubes.

The fluid pressure control circuit 1 is made up of a large number of parts and hence expensive to manufacture because the two speed controllers 4, 7 and the two pilot check valves 5, 8, which are separate from each other, are combined with the cylinder 2. The space that is required to accommodate the pipes is relatively large and cannot be reduced.

The process of assembling the fluid pressure control circuit 1 is tedious and time-consuming because the two speed controllers 4, 7, the two pilot check valves 5, 8, and the solenoid-operated valve 9 need to be interconnected by the pipes.

SUMMARY OF THE INVENTION

It is a general object of the present invention to provide a speed controller with a pilot check valve, which is made up of a relatively small number of parts and hence can be manufactured relatively inexpensively.

A major object of the present invention is to provide a speed controller with a pilot check valve, which requires a relatively small space to install pipes and can be assembled relatively simply.

The above and other objects, features, and advantages of the present invention will become more apparent from the following description when taken in conjunction with the accompanying drawings in which preferred embodiments of the present invention are shown by way of illustrative example.

DETAILED DESCRIPTION OF THE PREFERRED EMBODIMENTS

Figure 1:
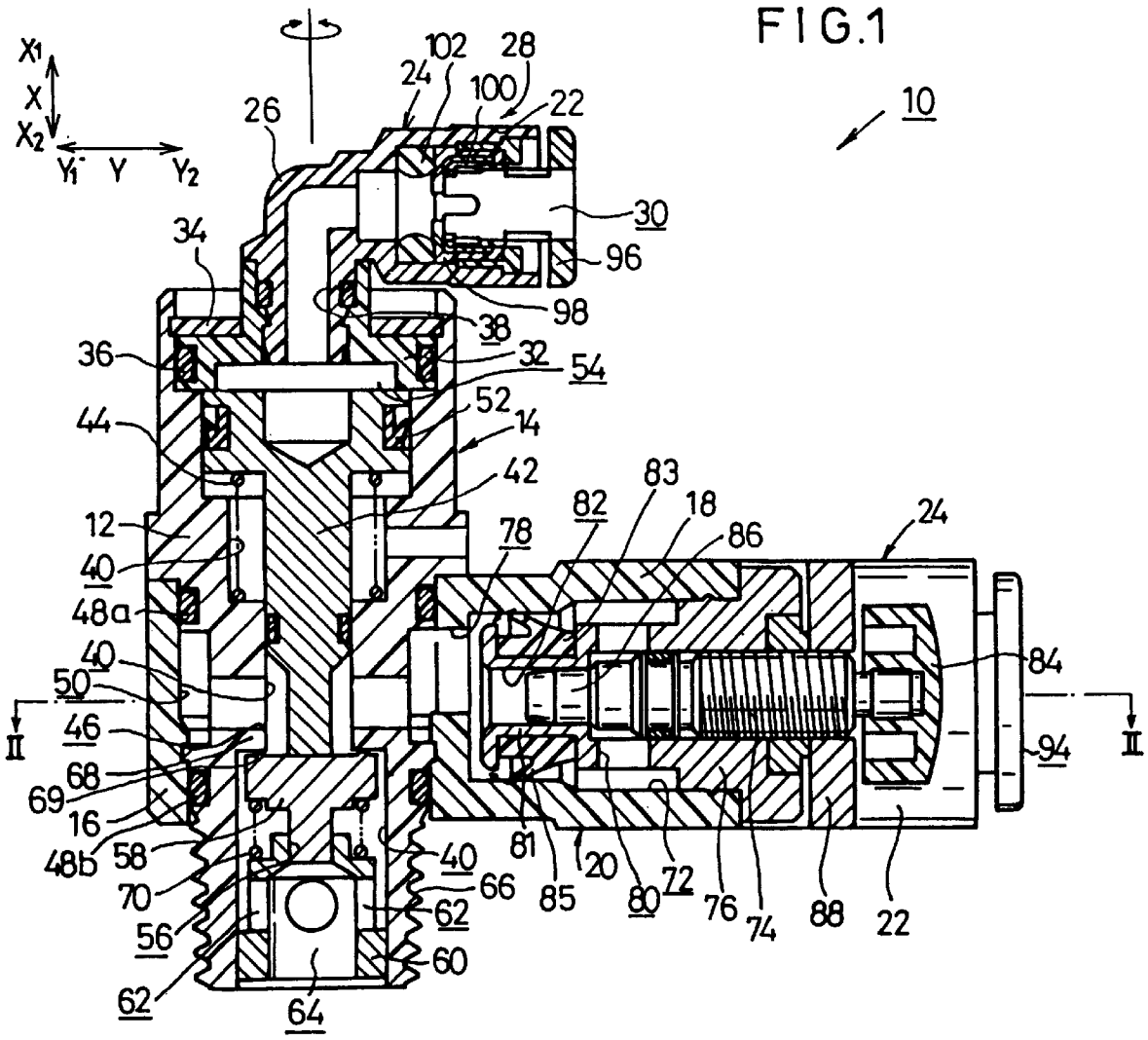
FIG. 1 is a vertical cross-sectional view of a speed controller with a pilot check valve according to an embodiment of the present invention.

FIG. 1 shows a speed controller 10 with a pilot check valve according to an embodiment of the present invention.

As shown in FIG. 1, the speed controller 10 comprises a pilot check valve 14 having a cylindrical first body 12, a flow control valve 20 having a cylindrical second body 18 including a ring 16 fitted over the first body 12 for rotation in a given direction about the axis of the first body 12, and a pipe joint 24 (see FIG. 2) having an elbow-shaped third body 22 coupled to the second body 18 substantially perpendicularly to the axis thereof. The first body 12, the second body 18, and the third body 22 should preferably be in the form of molded bodies of synthetic resin.

To an upper end of the first body 12, there is connected a pipe 26 bent substantially perpendicularly to the axis of the first body 12 and rotatable about the axis of the first body 12 in the directions indicated by the arrows. The tube 26 has a pilot port 30 defined in an end thereof by a pipe joint mechanism 28. The other end of the pipe 26 is rotatably mounted on the first body 12 by a flange 32 and a retaining ring 34. The flange 32 has an annular groove defined in an outer circumferential surface thereof and receiving an O-ring 36 that is held against an inner wall surface of the first body 12 to provide a hermetic seal. The pipe 26 defines a first passage 38 therein which is held in communication with the pilot port 30. The pipe joint mechanism 28 is constructed of parts that are essentially the same as those of the pipe joint 24.

The first body 12 has a first through hole 40 defined therein which extends along the axis thereof. A stem 42 of T-shaped cross section is disposed in a central region of the first through hole 40 for displacement in the directions indicated by the arrow X. The stem 42 is normally biased to move in the direction indicated by the arrow $X_1$ under the force of a first helical spring 44 disposed in the first through hole 40 and acting between the stem 42 and the first body 12.

Figure 2:
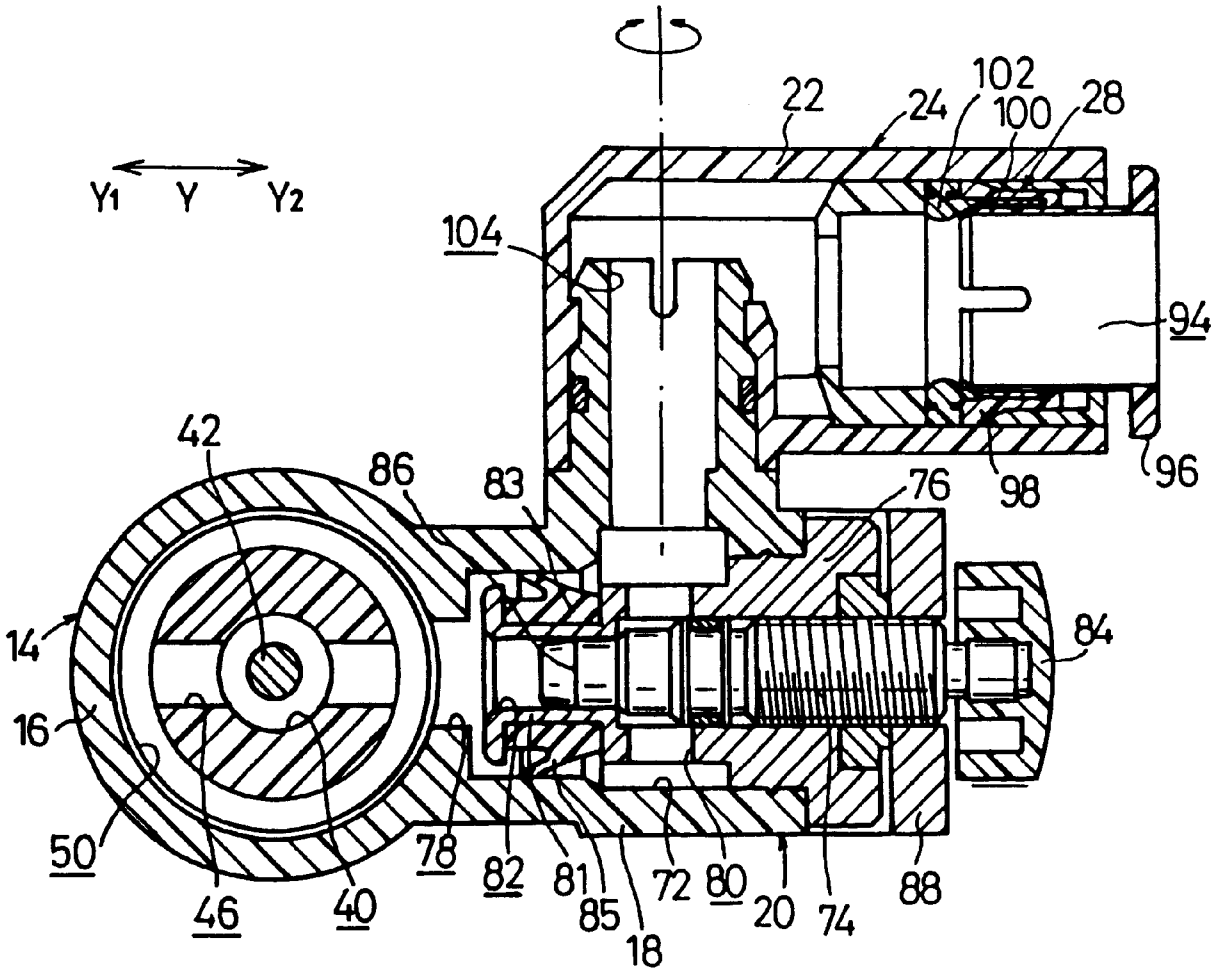
FIG. 2 is a cross-sectional view taken along line II—II of FIG. 1.

As shown in FIG. 2, the first body 12 also has a straight second passage 46 defined therein and extending substantially perpendicularly to the axis of the first through hole 40, the second passage 46 communicating with the first through hole 40. An annular gap 50 is defined between the first body 12 and the ring 16 and closed by a pair of O-rings 48*a*, 48*b*. The annular gap 50 is held in communication with the first through hole 40 and the second passage 46. The first through hole 40 is closed by a seal 52 mounted on an outer circumferential surface of the stem 42, with a first chamber 54 defined between the stem 42 and the flange 32.

A support member 60 which supports a valve body 58 through a hole 56 defined in an upper end thereof is fixedly mounted in a lower end of the first body 12. The support member 60 has a plurality of communication holes 62 communicating with the first through hole 40 and a first fluid inlet/outlet port 64 communicating with the communication holes 62. The lower end of the first body 12 has an externally threaded outer surface 66 for being threaded in a port of a cylinder (described later on).

An annular ledge 68 is disposed on an inner wall surface of the first body 12 near the second passage 46 and extends a certain length toward the central axis of the first body 12. The annular ledge 68 serves as a valve seat for the valve body 58, which is disposed between the stem 42 and the support member 60. The valve body 58 has on its upper surface an annular ridge 69 for being seated on a lower wall surface of the annular ledge 68. When the valve body 58 is closed, the annular ridge 69 develops an increased surface pressure on the annular ledge 68 for thereby securely preventing a fluid under pressure from leaking out.

A second helical spring 70 is interposed between and acts on the valve body 58 and the support member 60. The valve body 58 is normally biased in the direction indicated by the arrow $X_1$ under the force of the second helical spring 70 so as to be seated on the annular ledge 68.

Stated otherwise, the valve member 58 is axially displaced while being guided by the hole 56 and seated on the annular ledge 68 under the bias of the second helical spring 70. When a counterforce overcoming the bias of the second helical spring 70 is applied to the valve member 58, the valve member 58 is unseated off the annular ledge 68. The stem 42 and the valve member 58 are separate from each other, and positioned so as to be held against and spaced from each other.

The second body 18 of the flow control valve 20 has a second through hole 72 defined therein and extending axially thereof. The second through hole 72 has an end closed by a cap 76 in which a restriction adjustment screw 74 is threaded. The other end of the second through hole 72 communicates with the annular gap 50 through a third passage 78 that is defined in the second body 18.

As shown in FIG. 2, the cap 76 has a fourth passage 80 defined therein and extending substantially perpendicularly to the axis thereof, the fourth passage 80 communicating with the pipe joint 24. The fourth passage 80 also communicates with a hole 82 defined in an end of the cap 76 and extending axially of the cap 76.

The end of the cap 76 where the hole 82 is defined has a tubular seat 81 which receives a restriction 86 of the restriction adjustment screw 74. A check valve 83, which is mounted on the tubular seat 81, has a flexible annular tongue 85 that is held against an inner wall surface of the second body 18 to give the check valve 83 a fluid checking capability.

When the operator grips a knob 84 on an outer end of the restriction adjustment screw 74 and turns the knob 84 in one direction or the other, the restriction adjustment screw 74 is axially moved in one of the directions indicated by the arrow Y to adjust the spacing between restriction 86 and the seat 81 for thereby adjusting the valve opening of the flow control valve 20. The restriction adjustment screw 74 can be fixed in an adjusted axial position by a lock nut 88.

As illustrated in FIG. 2, the pipe joint 24 has a cylindrical third body 22 with a pipe joint mechanism 28 mounted on an outer end thereof. The pipe joint mechanism 28 has a second fluid inlet/outlet port 94 opening outwardly. The pipe joint mechanism 28 comprises a release bushing 96 having a plurality of recesses defined in a bottom thereof, a collet 98 of synthetic resin disposed around the release bushing 96, a ring-shaped chuck 100 of sheet metal disposed around the collet 98, and a seal 102 of an elastomer such as natural or synthetic rubber disposed around the collet 98.

Between the pipe joint 24 and the flow control valve 20, there is defined a fifth passage 104 which provides fluid communication between the second fluid inlet/outlet port 94 and the second through hole 72. The pipe joint 24 shown in FIG. 24 is rotatable in desired directions about an axis substantially perpendicular to the axis of the flow control valve 20.

Operation and advantages of the speed controller 10 will be described below.

Figure 3:
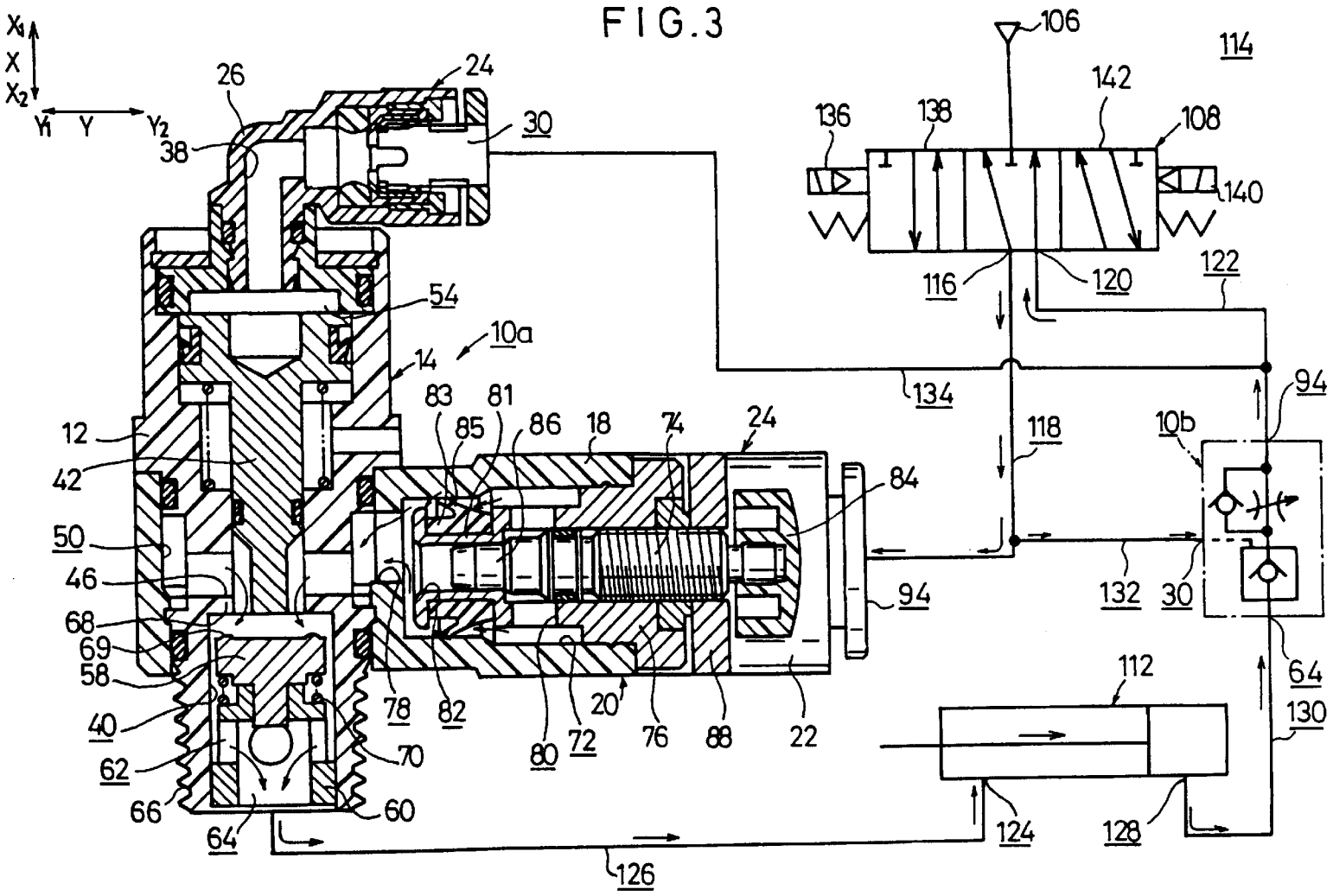
FIG. 3 is a circuit diagram of a fluid pressure circuit which incorporates the speed controller with the pilot check valve shown in FIG. 1, for supplying a fluid under pressure to a cylinder through the speed controller with the pilot check valve.
Figure 4:
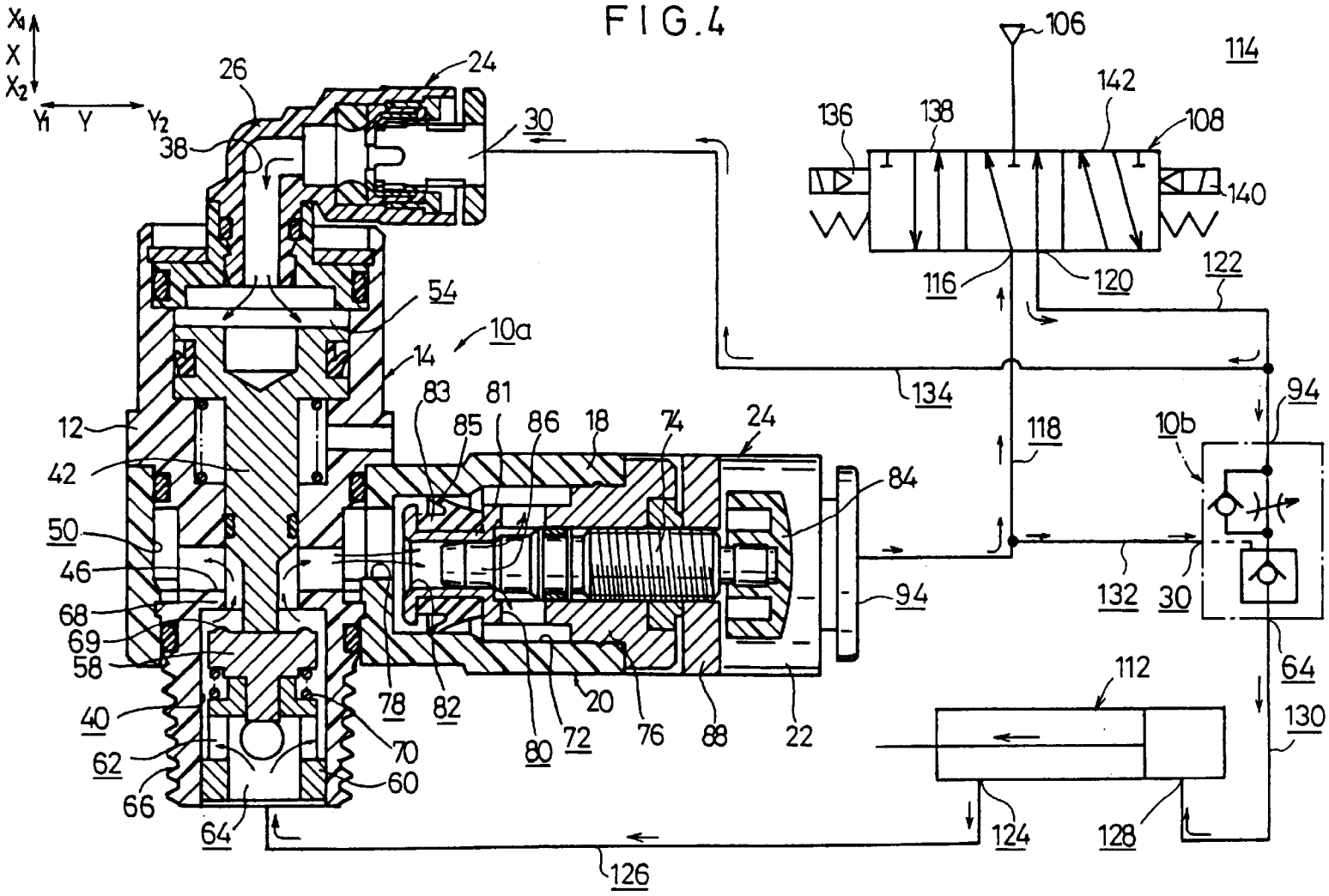
FIG. 4 is a circuit diagram of the fluid pressure circuit which incorporates the speed controller with the pilot check valve shown in FIG. 1, for discharging a fluid under pressure from the cylinder through the speed controller with the pilot check valve.

As shown in FIGS. 3 and 4, a pressure fluid source 106, a solenoid-operated directional control valve 108, first and second speed controllers 10*a*, 10*b*, each identical to the speed controller 10 shown in FIGS. 1 and 2, and a cylinder 112 are connected by conduits such as tubes, making up a fluid pressure circuit 114.

Specifically, the solenoid-operated directional control valve 108 has a port 116 connected to the second fluid inlet/outlet port 94 of the pipe joint 24 of the first speed controller 10*a* by a first fluid passage 118, and another port 120 connected to the second fluid inlet/outlet port 94 of the pipe joint 24 of the second speed controller 10*b* by a second fluid passage 122.

The first fluid inlet/outlet port 64 of the pilot check valve 14 of the first speed controller 10*a* is connected to a port 124 of the cylinder 112 by a third fluid passage 126, and the first fluid inlet/outlet port 64 of the pilot check valve 14 of the second speed controller 10*b* is connected to another port 128 of the cylinder 112 by a fourth fluid passage 130.

The port 116 of the solenoid-operated directional control valve 108 is connected to the pilot port 30 of the second speed controller 10*b* by a first branch passage 132 branched off from the first fluid passage 118. The other port 120 of the solenoid-operated directional control valve 108 is connected to the pilot port 30 of the first speed controller 10*a* by a second branch passage 134 branched off from the second fluid passage 122.

The solenoid-operated directional control valve 108 has first and second solenoids 136, 140 for shifting the valve selectively to first and second valve positions 138, 142. Specifically, the solenoid-operated directional control valve 108 is shifted to the first valve position 138 when the first solenoid 136 is energized, and to the second valve position 142 when the second solenoid 140 is energized. If the external threaded surfaces 66 of the first and second speed controllers 10*a,* 10*b* are directly threaded into the respective ports 124, 128 of the cylinder 112, then the third and fourth fluid passages 126, 130 may be dispensed with.

The knobs 84 of the respective first and second speed controllers 10*a,* 10*b* are manually turned to adjust the spacing between the restriction 86 and the seat 81 to a desired distance, after which the restriction adjustment screw 74 of each of the first and second speed controllers 10*a,* 10*b* is locked by the lock nut 88.

First, it is assumed that a fluid under pressure supplied from the pressure fluid source 106 is to be supplied through the solenoid-operated directional control valve 108 and the first speed controller 10*a* to the cylinder 112.

The pressure fluid source 106 is actuated, and the solenoid-operated directional control valve 108 is shifted to the first valve position 138. The fluid under pressure supplied from the pressure fluid source 106 is introduced through the port 116 of the solenoid-operated directional control valve 108 into the second fluid inlet/outlet port 94 of the pipe joint 24 of the first speed controller 10*a*.

The fluid under pressure from the second fluid inlet/outlet port 94 flows through the bent fifth passage 104 (see FIG. 2) into the second through hole 72 in the flow control valve 20, and then flows past the check valve 83, bending the tongue 85 thereof radially inwardly as indicated by the arrows. Specifically, when the fluid under pressure presses the tongue 85 radially inwardly as indicated by the arrows, the tongue 85 is displaced off the inner wall surface of the second body 18, creating a clearance through which the fluid under pressure flows. The fluid under pressure which has flowed past the check valve 83 is introduced through the third passage 78 and the second passage 46 into the first through hole 40.

The fluid under pressure introduced into the first through hole 40 presses the valve body 58, whose minimum operating pressure has been preset, downwardly in the direction indicated by the arrow $X_2$ into the position shown in FIG. 3. Specifically, the pressure of the introduced fluid overcomes the upward biasing force of the second helical spring 70, forcing the valve body 58 off the annular ledge 68 thereby to open the valve body 58. The fluid under pressure then flows past the valve body 58, and is supplied through the communication holes 62, the first fluid inlet/outlet port 64, and the port 124 into the cylinder 112, displacing the piston in the direction indicated by the arrow $Y_2$.

The fluid under pressure discharged from the cylinder 112 through the port 128 is introduced into the second speed controller 10*b,* which adjusts the pressure of the fluid to a predetermined pressure level. Thereafter, the fluid under pressure flows from the second speed controller 10*b* through the second fluid passage 122 into the solenoid-operated directional control valve 108, from which the fluid egresses into the atmosphere. The pressure regulating action of the second speed controller 10*b* is the same as the pressure regulating action (described later on) of the first speed controller 10*a,* and will not be described in detail below.

Now, it is assumed that a fluid under pressure is to be supplied to the cylinder 112, and then discharged from the cylinder 112 and regulated in pressure by the first speed controller 10*a*.

As shown in FIG. 4, when the second solenoid 140 is energized to shift the solenoid-operated directional control valve 108 to the second valve position 142, the fluid under pressure from the pressure fluid source 106 is supplied through the solenoid-operated directional control valve 108 and the second speed controller 10*b* to the port 128 of the cylinder 112, displacing the piston in the direction indicated by the arrow $Y_1$.

The fluid under pressure discharged from the cylinder 112 through the port 124 ingresses into the first fluid inlet/outlet port 64 of the first speed controller 10*a,* and then flows through the communication holes 62 into the first through hole 40.

At this time, the fluid under pressure is also introduced from the second fluid passage 122 through the second branch passage 134 into the pilot port 30, lowering the stem 42 in the direction indicated by the arrow $X_2$. The downward displacement of the stem 42 unseats the valve body 58 downwardly off the annular ledge 68, opening the valve body 58 as shown in FIG. 4.

Therefore, the fluid under pressure introduced into the first through hole 40 finds its way through the space between the valve body 58 and the annular ledge 68, and then flows through the second passage 46 and the third passage 78 into the flow control valve 20. The fluid under pressure in the flow control valve 20 is blocked by the tongue 85 of the check valve 83, and flows through the hole 82 in the cap 76 and passes through the clearance between the restriction 86 and the seat 81, whereupon the pressure of the fluid is adjusted to a desired pressure level.

The pressure-adjusted fluid is then introduced through the fourth passage 80 and the fifth passage 104 into the pipe joint 24, and thereafter discharged into the atmosphere through the first fluid passage 118 connected to the second fluid inlet/outlet port 94 and the solenoid-operated directional control valve 108.

In the above embodiment, the speed controller 10 and the pilot check valve 14, which have heretofore been separate from each other, are integral with each other. Therefore, the space required to accommodate pipes associated with the speed controller is reduced, and the number of parts that make up the speed controller is also reduced, with the result that the speed controller can be manufactured inexpensively.

Since the speed controller 10 and the pilot check valve 14 do not need to be interconnected by a pipe, the process of assembling the speed controller is relatively simple, and the process of interconnecting various components of the fluid pressure circuit incorporating the speed controller is also relatively simple.

Figure 5:
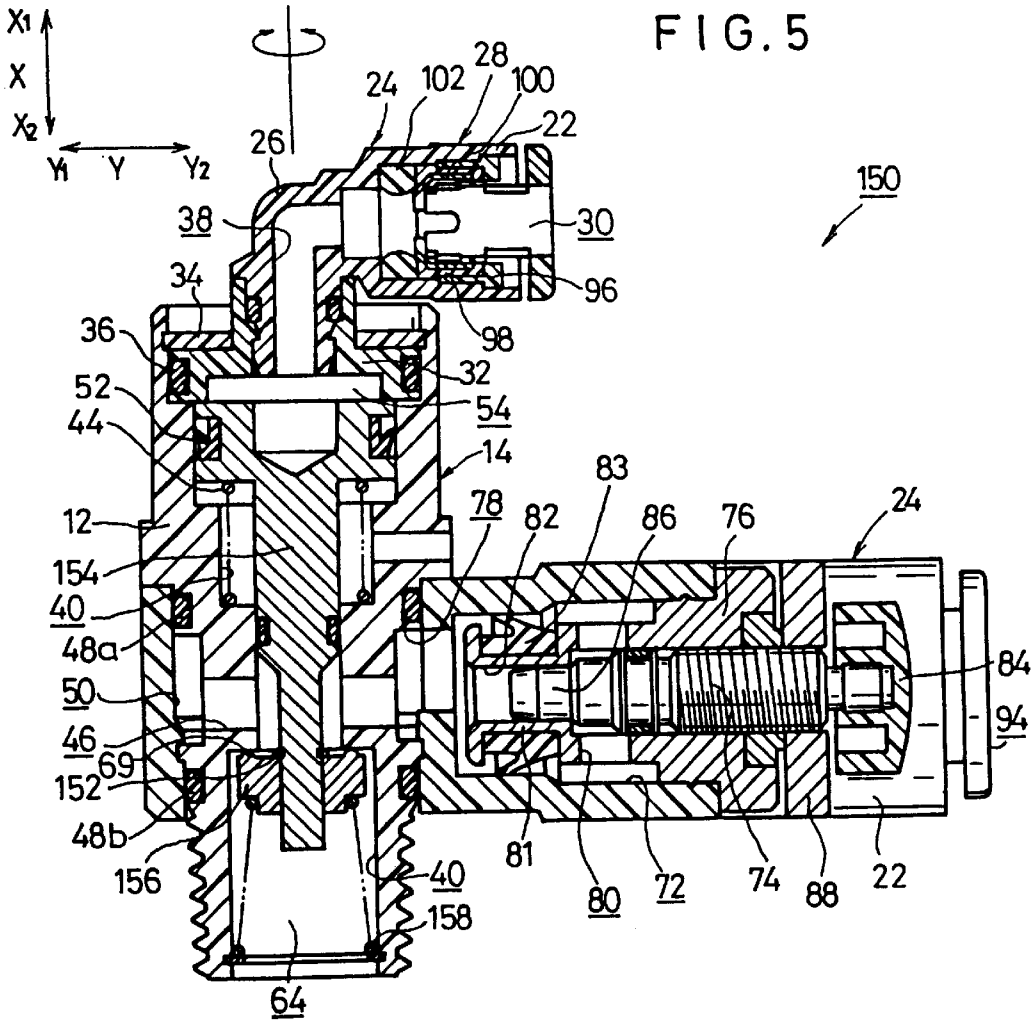
FIG. 5 is a vertical cross-sectional view of a speed controller with a pilot check valve according to another embodiment of the present invention.
Figure 6:
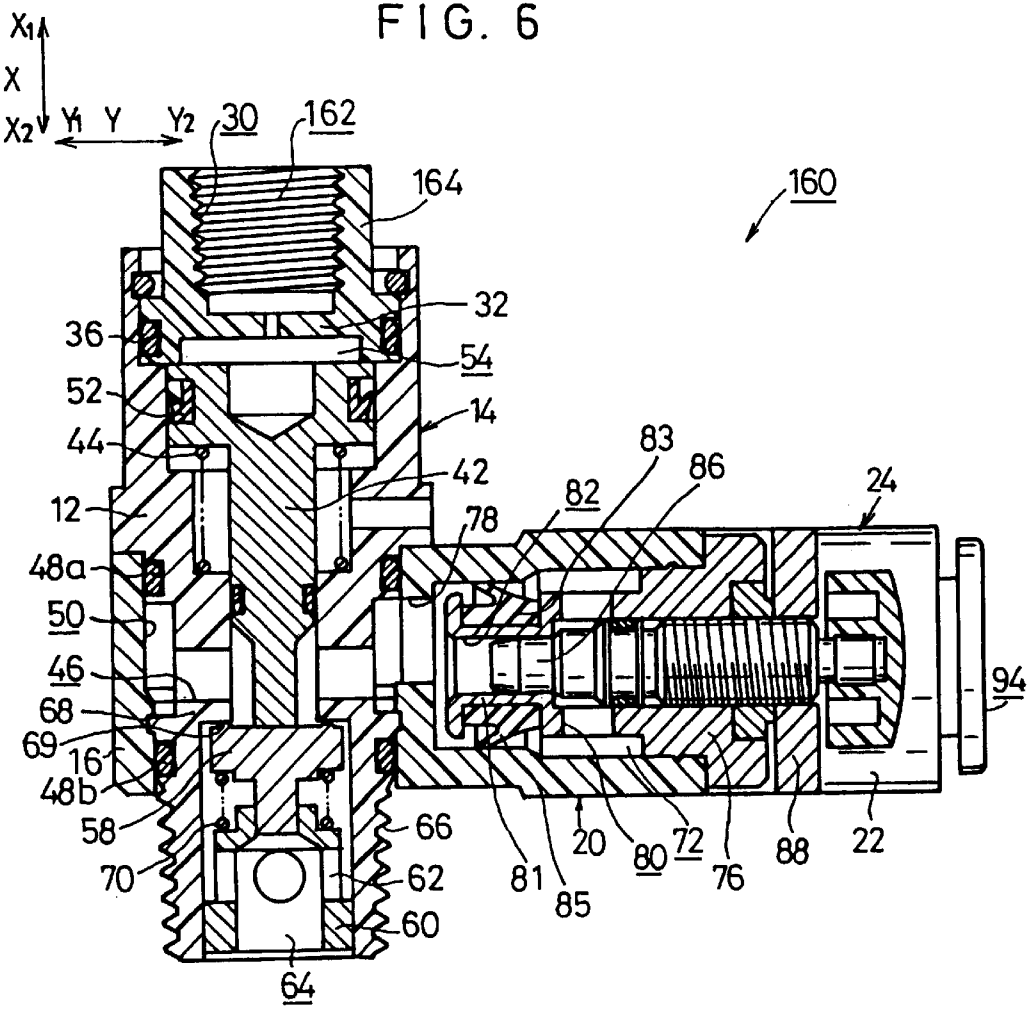
FIG. 6 is a vertical cross-sectional view of a speed controller with a pilot check valve according to still another embodiment of the present invention.
Figure 7:
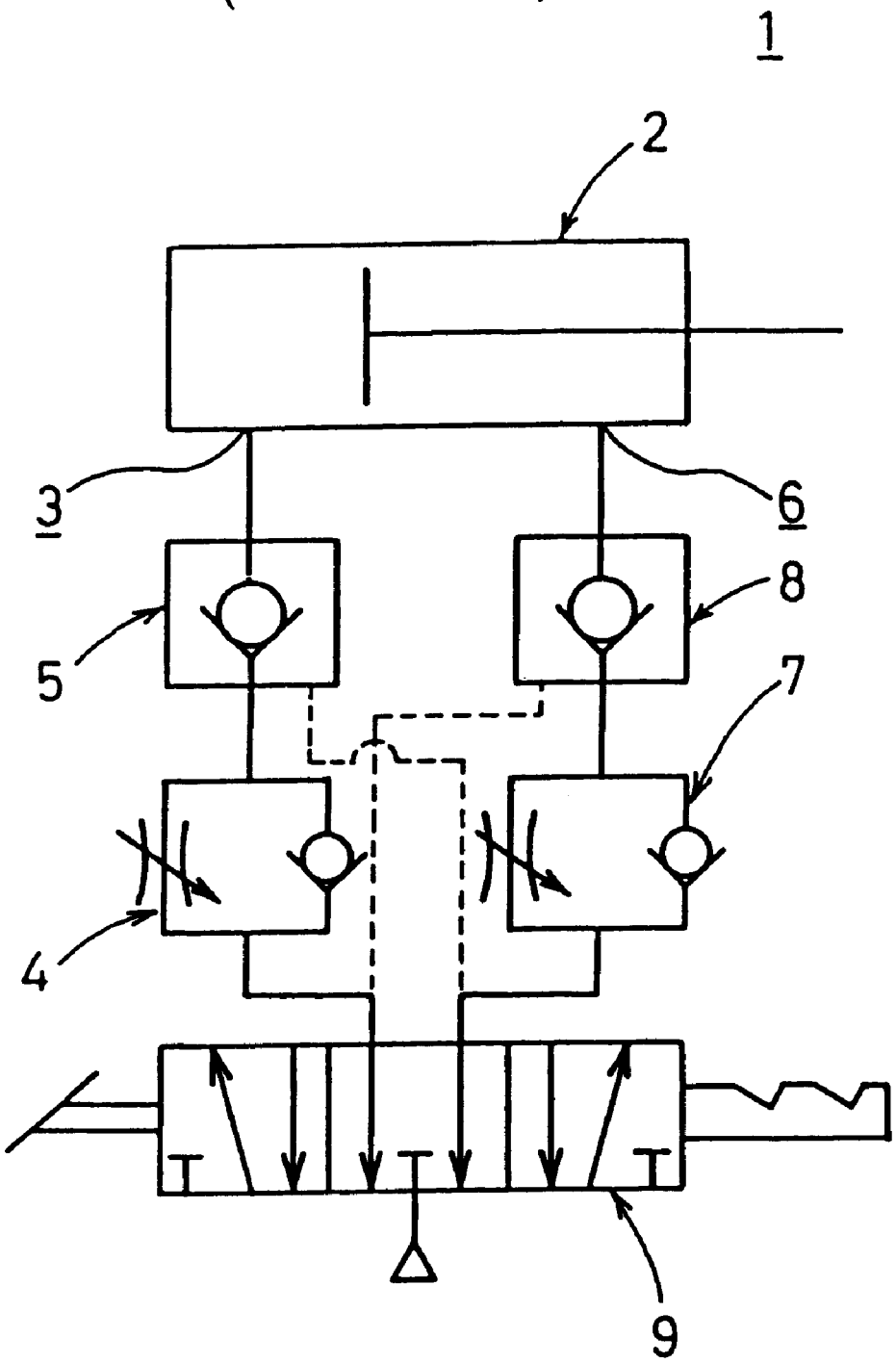
FIG. 7 (PRIOR ART)
FIG. 7 is a circuit diagram of a conventional fluid pressure control circuit including speed controllers.

FIGS. 5 and 6 show speed controllers according to other embodiments of the present invention. Those parts shown in FIGS. 5 and 6 which are identical to those shown in FIG. 1 are denoted by identical reference numerals, and will not be described in detail below.

A speed controller 150 shown in FIG. 5 differs from the speed controller 10 shown in FIG. 1 in that the support member 60 is no disposed in a lower portion of the first through hole 40 in the first body 12, but a valve body 156 is fixed to a lower end of an elongate stem 154 through a grip member 152. The valve body 156 is normally biased to move against the stem 154 in the direction indicated by the arrow $X_1$ by a third helical spring 158 disposed in the lower end of the first body 12 and acting on the valve body 156.

A speed controller 160 shown in FIG. 6 differs from the speed controller 10 shown in FIG. 1 in that it does not have the pipe 26 and the pipe joint 24, but a joint member 164 having an internally threaded hole 162 defined therein as the pilot port 30 is fixed to the upper end of the first body 12. It will be easily appreciated that the joint member 164 shown in FIG. 6 can be accommodated, in place of the pipe 26 and pipe joint 24, in any of the embodiments disclosed in the present specification, including the embodiment shown in FIG. 5.

The speed controllers 150, 160 according to the embodiments shown in FIGS. 5 and 6 are made up of fewer parts and hence can be manufactured less costly than the speed controller 10 shown in FIG. 1.

The speed controllers 150, 160 according to the embodiments shown in FIGS. 5 and 6 operate in the same way, and offers the same advantages, as the speed controller 10 shown in FIG. 1.

Although certain preferred embodiments of the present invention has been shown and described in detail, it should be understood that various changes and modifications may be made therein without departing from the scope of the appended claims.

What is claimed is:

1. A fluid pressure control circuit, comprising:

a pressurized fluid source;

a directional control valve connected to said pressurized fluid source;

a pair of speed controllers, each of which comprises:

a pilot check valve having a first body which has a first fluid inlet/outlet port defined in an end thereof and a pilot port defined in an opposite end thereof;

a flow control valve having a second body integral with said first body;

a pipe joint having a third body which has a second fluid inlet/outlet port defined in an end thereof, said third body being integral with said second body;

a flow adjustment member disposed in said flow control valve and extending into a fluid passage interconnecting said first fluid inlet/outlet port and said second fluid inlet/outlet port, for adjusting a rate of flow of a fluid under pressure in said fluid passage;

a valve body disposed in said pilot check valve for opening a fluid passage interconnecting said first fluid inlet/outlet port and said second fluid inlet/outlet port in response to a pilot fluid pressure supplied from said pilot port; and a stem movably disposed in said first body and a valve seat fixedly disposed in said first body, wherein said valve body is slidably fitted over said stem, the arrangement being such that said stem and said valve body are integrally displaceable in response to the pilot fluid pressure supplied from said pilot port for unseating said valve body off said valve seat;

a cylinder having respective ports, and respective fluid passages providing fluid communication between said respective ports and the first inlet/outlet ports of each of said pair of speed controllers;

wherein a first fluid passage from said directional control valve branches for providing fluid communication between the pressurized fluid source and the second inlet/outlet port of one of said pair of speed controllers, while simultaneously providing fluid communication between the pressurized fluid source and the pilot port of another of said speed controllers, and wherein a second fluid passage from said directional control valve branches for providing fluid communication between the pressurized fluid source and the second inlet/outlet port of the other of said pair of speed controllers, while simultaneously providing fluid communication between the pressurized fluid source and the pilot port of said one of said speed controllers.

2. A speed controller according to claim 1, wherein said second body has an integral ring disposed around said first body for rotation about an axis of said first body.

3. A speed controller according to claim 1, wherein said flow adjustment member comprises a restriction adjustment screw having a restriction disposed in said fluid passage and a knob rotatable to move said restriction axially in directions into and out of said fluid passage to adjust the rate of flow of a fluid under pressure in said fluid passage.

4. A speed controller according to claim 1, wherein said flow control valve has a check valve for allowing the fluid under pressure to flow from said second fluid inlet/outlet port to said first fluid inlet/outlet port and preventing the fluid under pressure from flowing from said first fluid inlet/outlet port to said second fluid inlet/outlet port.

5. A speed controller according to claim 1, further comprising a pipe joint mechanism mounted on said opposite end of said first body for rotation about an axis of said first body.

6. A speed controller according to claim 1, wherein said opposite end of said first body has an internally threaded hole defined therein as said pilot port.

7. A speed controller according to claim 1, further comprising a spring acting on said valve body for normally biasing said valve body against said stem.

* * * * *